US006381857B1

(12) United States Patent
Oldroyd

(10) Patent No.: US 6,381,857 B1
(45) **Date of Patent: *May 7, 2002**

(54) RAZOR WITH A MOVABLE CARTRIDGE

(75) Inventor: Brian Oldroyd, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/742,280

(22) Filed: Oct. 31, 1996

Related U.S. Application Data

(63) Continuation of application No. 08/313,055, filed as application No. PCT/US93/03439 on Apr. 12, 1993, now abandoned.

(30) Foreign Application Priority Data

Apr. 13, 1992 (GB) ..... 9208098

(51) Int. Cl.[7] ..... B26B 21/14

(52) U.S. Cl. ..... 30/527; 30/57; 30/526; 30/532

(58) Field of Search ..... 30/51, 57, 87, 30/89, 329, 330, 331, 30, 526, 527, 528, 532

(56) References Cited

U.S. PATENT DOCUMENTS

| | | | | |
|---|---|---|---|---|
| 1,247,581 A | | 11/1917 | Seitz | |
| 1,639,441 A | | 8/1927 | Spahr | 30/89 |
| 2,428,961 A | | 10/1947 | Courney | 74/520 |
| 2,510,951 A | | 6/1950 | Bleeker et al. | 30/40 |
| 3,935,639 A | | 2/1976 | Terry et al. | 30/47 |
| 3,950,848 A | | 4/1976 | Goldstein | 30/47 |
| 3,964,160 A | | 6/1976 | Gordon | 30/89 |
| 3,975,820 A | | 8/1976 | Torance | 30/47 |
| 4,152,828 A | | 5/1979 | Lund | 30/89 |
| 4,253,237 A | | 3/1981 | Jacobson | 30/89 |
| 4,275,498 A | | 6/1981 | Ciaffone | 30/47 |
| 4,573,266 A | | 3/1986 | Jacobson | 30/41 |
| 4,756,082 A | | 7/1988 | Apprille, Jr. | 30/89 |
| 4,797,997 A | * | 1/1989 | Packham et al. | 30/89 X |
| 4,879,811 A | | 11/1989 | Cooney | 30/89 |
| 4,926,553 A | | 5/1990 | Miskin et al. | 30/49 |
| 5,029,391 A | * | 7/1991 | Althaus et al. | 30/87 X |
| 5,050,301 A | | 9/1991 | Apprille, Jr. | 30/87 |
| 5,093,991 A | | 3/1992 | Hendrickson | 30/89 |
| 5,526,568 A | * | 6/1996 | Copelan | 30/87 X |
| 5,535,518 A | | 7/1996 | Althaus | 30/89 |
| 6,115,924 A | * | 9/2000 | Oldroyd | 30/527 |

FOREIGN PATENT DOCUMENTS

| | | | | |
|---|---|---|---|---|
| GB | 1460732 | | 1/1977 | B25B/21/08 |
| GB | 2086790 | * | 5/1982 | 30/57 |
| GB | 2116470 A | | 9/1983 | B26B/21/52 |
| GB | 2172236 A | | 9/1986 | B26B/21/52 |
| WO | WO 96/30175 | | 10/1996 | B26B/21/22 |

* cited by examiner

*Primary Examiner*—Boyer Ashley
(74) *Attorney, Agent, or Firm*—Edward S. Podszus

(57) ABSTRACT

Mechanism for connecting a shaving cartridge to a razor handle with shell bearings to allow the cartridge to swivel about an axis parallel to the edge of the cartridge blades and each shell bearing supported on a four bar linkage to permit the cartridge to rock end-to-end about an axis parallel to the direction of shaving.

31 Claims, 5 Drawing Sheets

RAZOR WITH A MOVABLE CARTRIDGE

This application is a continuation of Ser. No. 08/313,055, filed May 8, 1995, now abandoned, which is a National Stage (371) of PCT/US93/03439, filed Apr. 12, 1993.

This invention relates to a cartridge razor which includes a handle and a cartridge carrier mounted to the handle in a way which allows the cartridge to rotate relative to the handle about an axis which is perpendicular to the edge of a blade of the cartridge and parallel to the surface to be shaved, thereby to accommodate changing contours of a surface to be shaved.

Twin-blade cartridges which swivel about an axis parallel to the blade edges are well-known. Such swivelling improves contact between the blades and the surface being shaved, and it has been found that the swivelling about the orthogonal axis improves blade contact, end to end. See GB-A-2116470 and GB-A-2172236.

Although the razor of GB-A-2116470 provides improved conformance with facial contours, end to end of the shaving cartridge, there is scope for further improvement and it is one object of the present invention to achieve such an improvement. What is required is a way of mounting the cartridge to the handle which allows the cartridge to move smoothly and with a minimum of friction about the axis perpendicular to the blade edge or edges, whenever there is a change of the angle between the handle and the surface being shaved. Further, the mounting should be compact enough not to interfere unduly with the user's vision of the area being shaved, or with subsequent rinsing of the cartridge.

A cartridge razor of the type initially defined above, and in accordance with the present invention, is characterized in that the rotation perpendicular to the edge of a blade of the cartridge i.e. end-to-end rocking movement of the cartridge is about an axis of rotation which lies either on or below the said surface to be shaved.

By so locating the rotation centre, it is possible to establish a stable reaction to changing contours of the surface being shaved, which ensures that the end to end rocking movements of the cartridge do not involve any motion in the line of the blade edges relative to that surface.

Conventional swivelling movement parallel to the edge of the or each blade of the cartridge can be provided between a cartridge carrier and the cartridge. Preferably, the axis of rotation of the cartridge parallel to the blade edge(s) is also on or below the surface to be shaved. When the two orthogonal rotational axes intersect, the combination of the two swivel axes creates and effective universal joint on or below the surface being shaved.

The cartridge carrier can itself be carried on a four-bar linkage which lies in a plane parallel to the blade edges. A suitable four-bar linkage has first and second transverse links, each with a mid-point pivotally mounted to the handle, and two opposite ends each pivotally mounted to an extension link, itself mounted pivotally to the end of the cartridge carrier, so that each end of the carrier is supported by one of the extension links of the four-bar linkages.

Conveniently, each of the four-bar transverse links is a bell crank having an apex at its mid-point and cranked left hand and right hand limbs extending in opposite directions from the apex but subtending an angle of less than 180°, for example, 60°, so that the bell crank points, like an arrow head, towards the cartridge carrier. This is one effective way to move the centre of rotation of the carrier away from its mounting in the handle and towards the desired position on or behind the surface to be shaved.

A four-bar linkage as described immediately above has already been disclosed, see GB 1460732, but only as a pair of such linkages, to provide swivel motion about the axis parallel to the blade edges. The rotational axis is above the surface to be shaved.

Preferably, a biasing spring is provided, to urge the carrier to a start disposition so that during shaving whenever the cartridge is no longer subject to forces tending to rotate it about the rotational axis perpendicular to the blade edges, the biasing means will urge the carrier back to its start disposition. A preferred biasing spring is a resilient wishbone mounted at its apex to the said bell crank and with its limbs pressing against the two extension links.

For a better understanding of the invention, and to show more clearly how the same may be carried into effect, reference will now be made, by way of example, to the accompanying drawings, in which.

Figure 1:
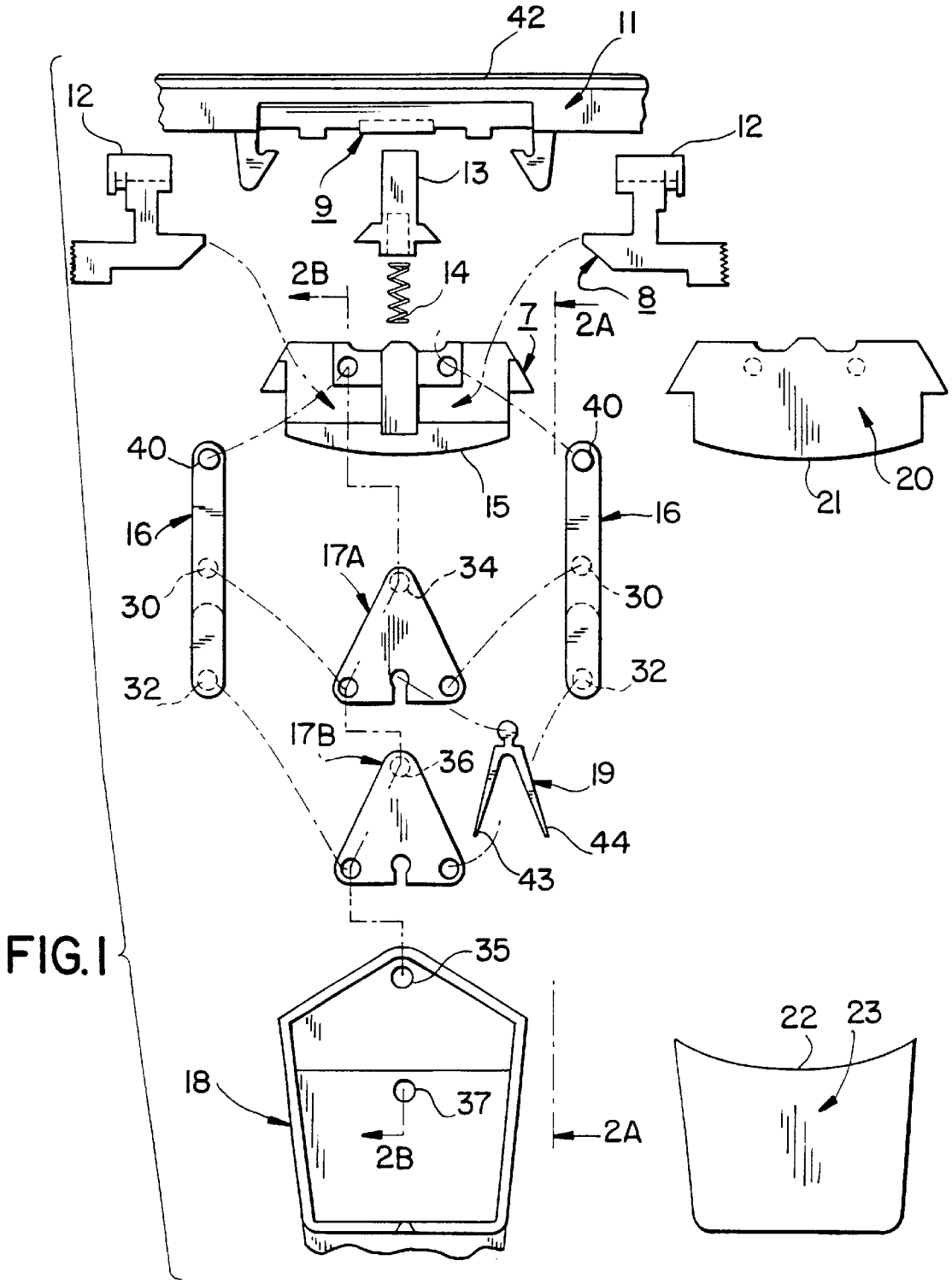
FIG. 1 is a first elevation, exploded, to show various individual components of a preferred embodiment of razor in accordance with the invention.

Referring to FIG. 1, a shaving cartridge 11 is held by a pair of shell bearings 12, in a manner known per se, to the remainder of the razor system. A plunger 13 is mounted in the razor for endwise movement and a compression spring 14 acts on the plunger to urge it into endwise pressure on a ramp surface 9 on the cartridge, thereby to urge the cartridge into a centered median disposition in the shell bearings 12, as is known per se. To change the cartridge the shell bearings are squeezed together. Not only does this release the bearings but it also causes ramp surfaces 7, 8 to depress the plunger 13 against the action of the spring 14, to release the cartridge 11 from the razor. This also is known per se.

A cartridge carrier 15 carries the shell bearings 12 and plunger 13. The carrier is itself mounted on a four-bar linkage parallel with the blade edges. The linkage comprises a pair of extension links 16, one on each side of each of a pair of bell cranks 17A, 17B. These cranks are themselves pivotally mounted to a planar area 18 of the razor handle. A resilient wishbone spring 19 is clipped on to the upper bell crank 17A so that its two legs press against the extension links 16 to centre the linkage. A plate 20 covers the carrier 15 and has an arcuate edge 21 which abuts a corresponding edge 22 on a cover plate 23 for the handle area 18. The arcs of the edges 21, 22 are centered on the centre of rotation of the cartridge carrier 15 so that, when the carrier 15 rocks to follow facial contours, there is relative movement between the edges 21 and 22. In the preferred embodiment this relative motion can be sliding movement.

Figure 2A:
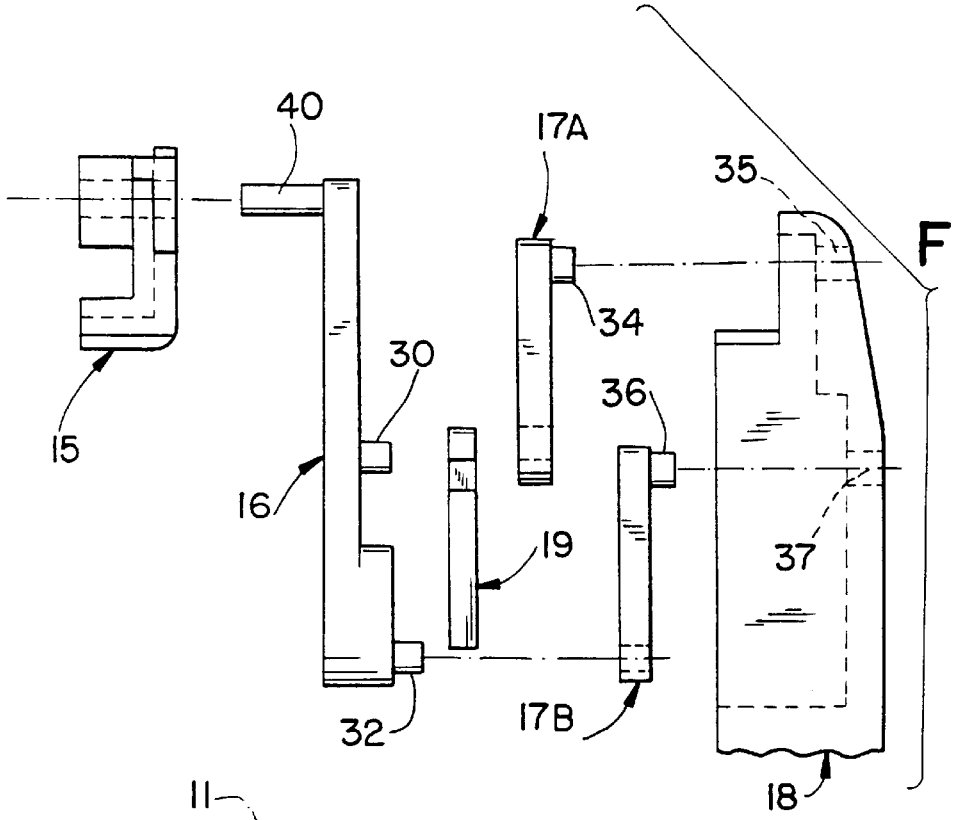
FIG. 2A is an exploded side view of a portion of the linkage as seen along view line 2A—2A of FIG. 1.
Figure 2B:
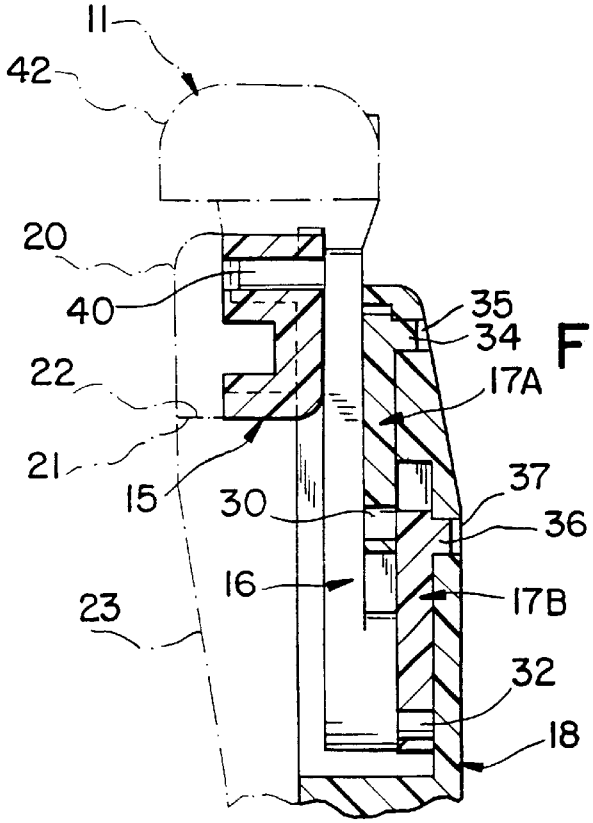
FIG. 2B is a longitudinal cross sectional view as taken along line 2B—2B of FIG. 1, the parts being shown in their assembled position.

Referring now to FIGS. 2A and 2B, the four-bar linkage is shown from the side so that only one of the extension links 16 is visible. Each such link 16 has an upper boss 30 to engage with the upper bell crank 17A and a lower boss 32 to engage with the lower crank 17B. At the apex of the upper crank 17A is a boss 34 which is carried in a bore 35 in the handle 18. At the apex of the lower crank 17B is a boss 36 which is carried in a bore 37.

Figure 3:
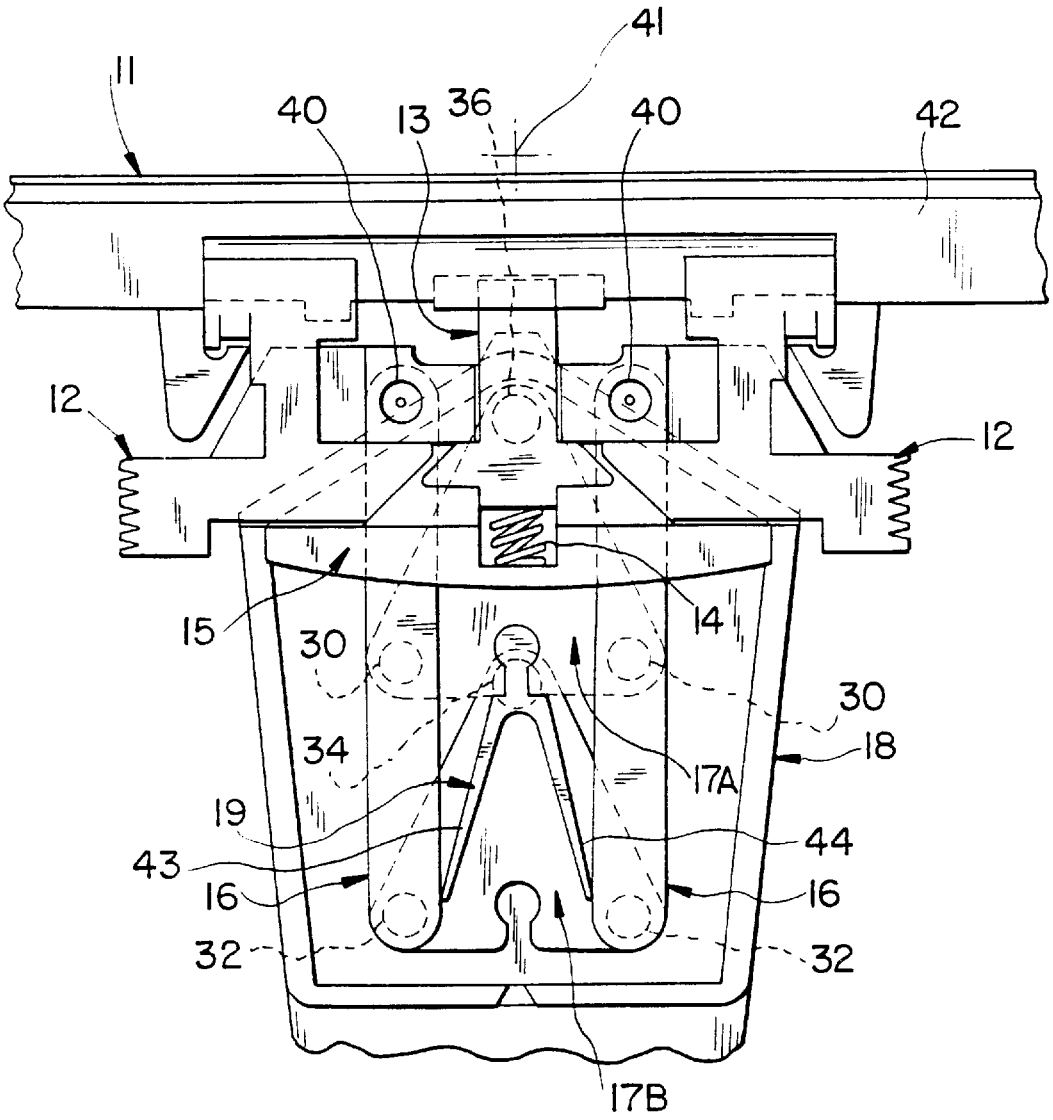
FIG. 3 is a front elevational view of the assembled razor with the cover plates removed.

Referring now to FIG. 3, each extension link 16 is pivotally connected to the cartridge carrier 15 by a boss 40. The carrier 15 rocks about these two bosses 40 in a locus which corresponds to a centre of rotation 41 which is determined by the geometry of the bell cranks 17A and 17B. It can be seen that the centre of rotation 41 is on the opposite side of the shaving surface 42 of the cartridge from the razor handle, that is, below the surface to be shaved.

Figure 4:
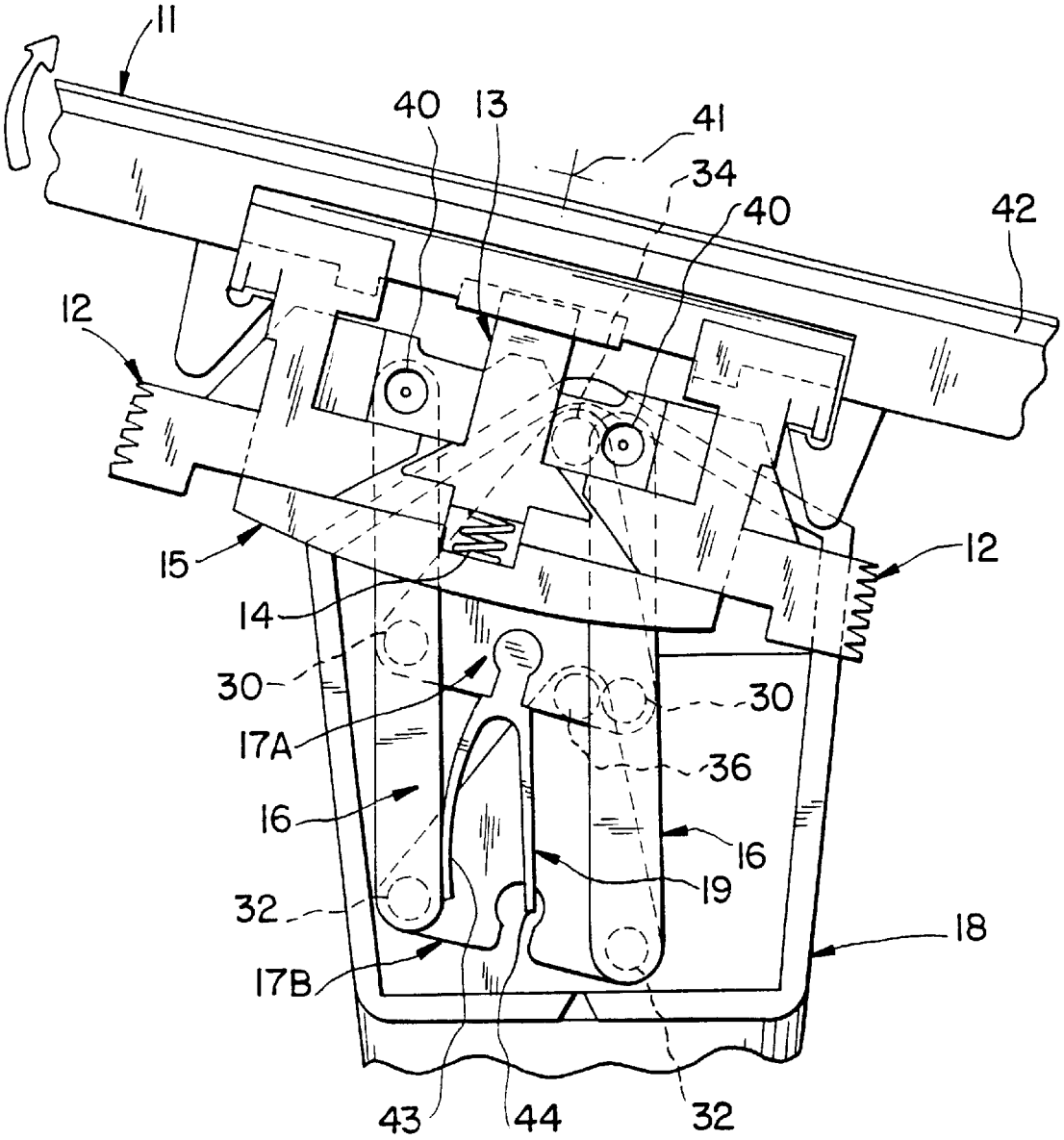
FIG. 4 is a front elevational view similar to FIG. 3 with the razor shown in a tilted position.

Referring now to FIG. 4, a 15° tilt about the centre of rotation 41 has the effect of pressing the left hand leg 43 of the wishbone 19 against the left hand link 16 and the resultant elastic deformation of the leg produces a force tending to restore the four-bar linkage to a central disposition. The other leg 44 provides the restoring force when the rotation is in the other direction. With rotation as shown in FIG. 4, the leg 44 simply moves out of contact with its adjacent extension link 16.

Figure 5:
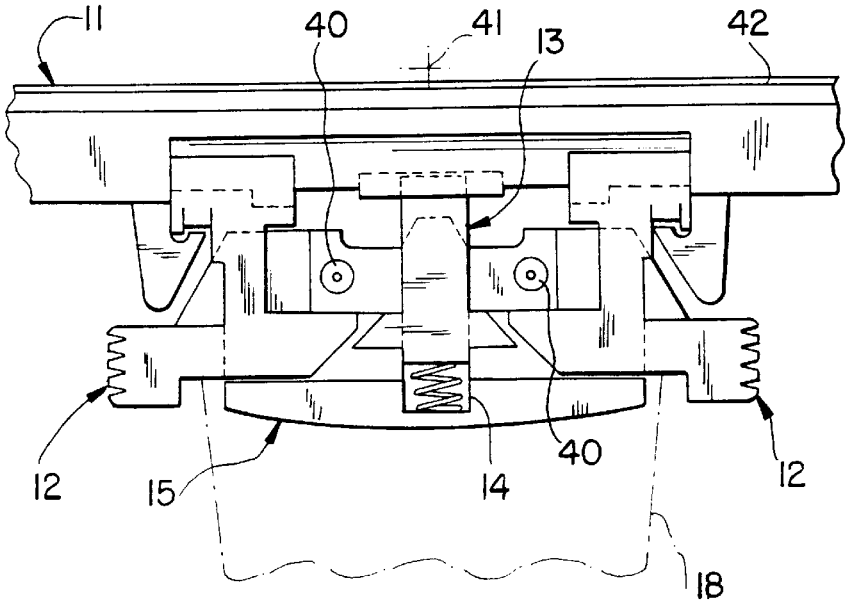
FIG. 5 is a fragmentary elevational view showing the cartridge being retained by the carrier; and, FIG. 6 is a view similar to FIG. 5 showing the cartridge released from the carrier.
Figure 6:
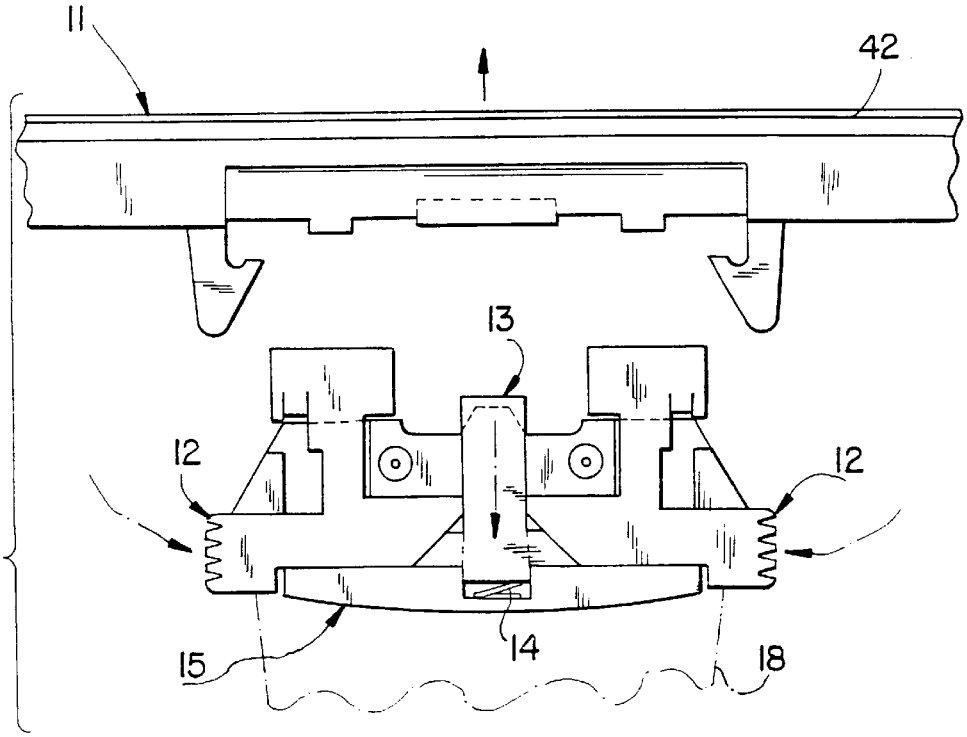

FIGS. 5 and 6 show how the cartridge is mounted and separated from the remainder of the razor. As is mentioned above, the construction and operation is in itself already known, as from the SENSOR (trademark) razor, sold by the present Applicant.

What is claimed is:

1. A cartridge razor which includes a handle (18) and a cartridge carrier (15) mounted to the handle in a way which allows a cartridge mounted on the carrier to rotate relative to the handle, about an axis which is perpendicular to an edge of a blade of the cartridge and parallel to a surface to be shaved, with changing contours of the surface to be shaved and characterized in that said rotation is about a centre of rotation (41) which lies either on or below the said surface to be shaved, wherein the cartridge carrier is carried on a four-bar linkage (16, 17) which lies in a plane parallel to the blade edge, wherein the four-bar linkage comprises first and second transverse links (17), each with a mid-point pivotally mounted to the handle, and two opposite ends each pivotally mounted to an extension link (16) pivotally mounted to one end of the cartridge carrier.

2. A wet razor comprising a handle (18), a razor head (11) having at least one razor blade, and a connecting device for connection of the razor head to the handle, wherein the razor head is pivotable in two directions relative to the handle about a first pivot axis (41) located essentially perpendicular to a cutting edge of the at least one razor blade and essentially in or above a plane of the razor blade, and wherein the connecting device comprises at least one four-bar mechanism having a lower transverse link (17B), an upper transverse link (17A) and two connecting extension links (16), of which at least one of the transverse links is pivotally mounted about a second axis (36, 37) which is essentially parallel to the first pivot axis and intersects with the at least one of the transverse links of the four-bar mechanism.

3. A wet razor according to claim 2, wherein the lower transverse link is pivotally connected to the handle.

4. A wet razor according to claim 3 wherein both lower and upper transverse links are pivotally connected to the handle.

5. A wet razor according to claim 2, wherein the connecting device further comprises a spring biasing the four-bar mechanism to a start disposition.

6. A wet razor according to claim 5 wherein the spring is disposed between the four links of the four-bar mechanism.

7. A wet razor according to claim 2, wherein the second axis intersects with the lower transverse link at a right angle.

8. A wet razor according to claim 7, wherein the second axis intersects with the mid-point of the lower transverse link.

9. A wet razor according to claim 7, wherein the links are at least partially formed by bar elements.

10. A wet razor according to claim 7, wherein the links are at least partially formed by plate elements.

11. A wet razor according to claim 7, wherein the connecting device includes a cartridge carrier that is pivotally connected to the four-bar mechanism.

12. A wet razor according to claim 7, wherein the razor head comprises a double razor blade assembly.

13. A wet razor comprising a handle (18), a razor head (11) having at least one razor blade having a cutting edge, a cartridge carrier (15) supporting the razor head, and a four-bar linkage (16, 17) operatively connecting the cartridge carrier to the handle, the four-bar linkage lying in an approximate plane parallel to the blade cutting edge and comprising a lower transverse link (17B), an upper transverse link (17A) and two connecting extension links (16), of which at least one of the transverse links has a mid-point pivotally mounted to the handle, wherein the four-bar linkage permits end-to-end rotation of the razor head with changing contours of a surface to be shaved, said rotation being about an effective first pivot axis (41) located perpendicular to the blade cutting edge and essentially in or above a plane of the razor blade.

14. A wet razor according to claim 13 wherein the links are at least partially formed by bar elements.

15. A wet razor according to claim 13 wherein the links are at least partially formed by plate elements.

16. A wet razor according to claim 13 wherein the four-bar linkage is pivotally connected to the cartridge carrier.

17. A wet razor according to claim 13 wherein the razor head comprises a double razor blade assembly.

18. A wet razor according to claim 13 wherein both lower and upper transverse links are pivotally connected to the handle.

19. A wet razor according to claim 13 further comprising a spring biasing the four-bar linkage to a start disposition.

20. A wet razor according to claim 19 wherein the spring is disposed between the four links of the four-bar linkage.

21. A wet razor handle for supporting a shaving cartridge including one or more blades having cutting edges, said handle comprising:

an elongated hand engaging structure having an upper end, a housing structure at the upper end, said housing structure having a cavity, cartridge supporting bearings located above said housing structure that support said cartridge for pivotal movement of said cartridge about a first axis that is parallel to the cutting edges of said one or more blades, a linkage that carries said cartridge supporting bearings in movable relation to said housing and provides pivotal movement of said cartridge supporting bearings about a virtual second axis that is perpendicular to said first axis and is located above said housing structure to provide a rocking motion of said cartridge, said linkage comprising first and second extension links that each carry a respective said cartridge supporting bearing, said extension links having lower portions, mid-portions and upper portions, and, at least one transverse link having ends, said transverse link being pivotally connected at said ends to said lower portions of said extension links and is pivotally connected at a midpoint of said transverse link to said hand engaging structure at a third pivot axis that is parallel to said second pivot axis, said transverse link and said lower portions and said mid-portions of said extension links being located within said cavity in said housing structure, the upper portions of said extension links extending upward and out of said housing structure, said handle also including motion-limiting structure that maintains said mid-portions of said extension links in a predetermined sideways spaced relation so as to limit sideways travel of said extension links, whereby pivoting of said transverse link about said third axis causes movement of one said extension link in an upward direction and simultaneous movement of the other said extension link in a downward direction so as to cause pivoting of said cartridge supporting bearings with respect to said virtual second axis.

22. The handle of claim 21 wherein said third pivot axis is at a fixed location on said housing structure.

23. The handle of claim 21 wherein said motion-limiting structure comprises a second transverse link having ends, said second transverse link being pivotally connected at said ends to said mid-portions of said extension links.

24. The handle of claim 21 further comprising a biasing spring tending to bias said transverse link to an orientation in which said upper portions of said extension links are at the same height with respect to said housing structure.

25. The handle of claim 21 wherein said extension links are straight.

26. The handle of claim 21 wherein said cartridge supporting bearings are pivotally connected to said upper portions of said extension links and are separate from said extension links.

27. The handle of claim 21 wherein said cartridge supporting bearings comprise shell bearings.

28. The handle of claim 21 wherein said virtual second axis is located on or below the surface to be shaved.

29. The handle of claim 21 wherein said ends of said transverse link are connected to said lower portions of said extension links to rotate about pivot axes that are at fixed locations with respect to said lower portions of said extension links.

30. The handle of claim 21 wherein said transverse link is a bell crank.

31. The handle of claim 21 wherein the cartridge supporting bearings are connectable to an underside of said shaving cartridge.

* * * * *